US010950398B2

(12) United States Patent
Ban

(10) Patent No.: US 10,950,398 B2
(45) Date of Patent: Mar. 16, 2021

(54) FOUR-WAY SWITCH INCLUDING MALFUNCTION PREVENTION STRUCTURE

(71) Applicant: ALPS ALPINE CO., LTD., Tokyo (JP)

(72) Inventor: Jisub Ban, Gwangju (KR)

(73) Assignee: ALPS ALPINE CO., LTD., Tokyo (JP)

( * ) Notice: Subject to any disclaimer, the term of this patent is extended or adjusted under 35 U.S.C. 154(b) by 0 days.

(21) Appl. No.: 16/526,154

(22) Filed: Jul. 30, 2019

(65) Prior Publication Data

US 2019/0355532 A1 Nov. 21, 2019

Related U.S. Application Data

(63) Continuation of application No. PCT/JP2017/043643, filed on Dec. 5, 2017.

(30) Foreign Application Priority Data

Feb. 8, 2017 (KR) ..... 10-2017-0017310

(51) Int. Cl.
*H01H 25/04* (2006.01)
*H01H 21/50* (2006.01)

(52) U.S. Cl.
CPC ..... *H01H 25/041* (2013.01); *H01H 21/50* (2013.01); *H01H 2225/01* (2013.01); *H01H 2239/03* (2013.01)

(58) Field of Classification Search
CPC ..... H01H 25/041; H01H 2225/01
See application file for complete search history.

(56) References Cited

U.S. PATENT DOCUMENTS 5,396,030 A * 3/1995 Matsumiya ..... H01H 25/041 200/339
6,657,141 B1 12/2003 Myojin
(Continued)

FOREIGN PATENT DOCUMENTS

JP S56-114230 9/1981
JP 2000-149718 5/2000
(Continued)

OTHER PUBLICATIONS

Japanese Office Action for 2018-566775 dated Feb. 12, 2020.
International Search Report dated Feb. 27, 2018 in PCT/JP2017/043643 filed on Dec. 5, 2017.

*Primary Examiner* — Felix O Figueroa
(74) *Attorney, Agent, or Firm* — IPUSA, PLLC

(57) ABSTRACT

A four-way switch including a knob configured to be tilted in four directions to perform a switching operation in the four directions; a housing to which the knob is attached in a tiltable manner; a stopper formed on a surface of the housing so as to protrude by a predetermined height, the stopper being configured to limit a downward motion of the knob by contacting a portion of a lower surface of the knob while the knob is tilted; a guide protrusion formed on the lower surface of the knob so as to protrude by a predetermined length; and a guide groove portion formed on the surface of the housing so as to protrude by a predetermined height so as to face the guide protrusion, the guide groove portion including a recess portion having a structure that engages with the guide protrusion.

10 Claims, 6 Drawing Sheets

(56) References Cited

U.S. PATENT DOCUMENTS

| | | | | |
|---|---|---|---|---|
| 6,897,391 | B2 * | 5/2005 | Gavalda | G05G 9/02 200/17 R |
| 9,653,234 | B2 * | 5/2017 | Matsumoto | H01H 25/008 |
| 2007/0144290 | A1 | 6/2007 | Lee et al. | |
| 2015/0255234 | A1 | 9/2015 | Matsumoto | |

FOREIGN PATENT DOCUMENTS

| | | |
|---|---|---|
| JP | 2007-173098 | 7/2007 |
| JP | 2014-093133 | 5/2014 |
| KR | 10-2004-0041760 | 5/2004 |

* cited by examiner

FOUR-WAY SWITCH INCLUDING MALFUNCTION PREVENTION STRUCTURE

CROSS-REFERENCE TO RELATED APPLICATION

The present application is a continuation application of International Application No. PCT/JP2017/043643 filed on Dec. 5, 2017, which is based on and claims priority to Korean Patent Application No. 10-2017-0017310 filed on Feb. 8, 2017. The contents of these applications are incorporated herein by reference in their entirety.

BACKGROUND OF THE INVENTION

1. Field of the Invention

The present invention relates to a four-way switch including a malfunction prevention structure, and more particularly to a four-way switch that solves the problem of two switches operating simultaneously when pushing an edge portion of the knob of the four-way switch, and the problem of not operating accurately in four directions.

2. Description of the Related Art

FIG. 1 is a perspective view illustrating a conventional four-way switch.

In a four-way switch, there has been a problem that when an edge portion is pushed, two switches are simultaneously pushed and operated inadvertently. As a result, there has been a problem that it has not been possible to realize accurate switch operations performed by pushing the switch in four directions.

In order to solve the above problem, as illustrated in FIG. 1, a protrusion 13 is formed on the upper surface of a housing 12 to prevent two switches from being pushed and operated when an edge portion of a knob 11 is pushed.

The protrusion 13 is commonly referred to as a stopper. The protrusion 13 having such a structure limits the motion of the knob 11 when an edge portion of the knob 11 is pushed, until the switch reaches being on-stroke.

The size of the protrusion 13 varies according to the size of a full-stroke. That is, the longer the full-stroke, the lower the height of the protrusion 13. In a case where the height of the protrusion 13 is low, when an edge portion of the knob 11 is pushed, the knob 11 is pushed down to on-stroke, and as a result, two switches are caused to operate, and the above problem cannot be resolved.

Accordingly, there is a need for a technique relating to a four-way switch that solves the problem of the conventional technology.

Patent Document 1: Korean Patent Publication No. 10-2004-0041760 (Publication date: May 20, 2004)

SUMMARY OF THE INVENTION

According to one aspect of the present invention, there is provided a four-way switch including a knob configured to be tilted in four directions to perform a switching operation in the four directions; a housing to which the knob is attached in a tiltable manner; a stopper formed on a surface of the housing so as to protrude by a predetermined height, the stopper being configured to limit a downward motion of the knob by contacting a portion of a lower surface of the knob while the knob is tilted; a guide protrusion formed on the lower surface of the knob so as to protrude by a predetermined length; and a guide groove portion formed on the surface of the housing so as to protrude by a predetermined height so as to face the guide protrusion, the guide groove portion including a recess portion having a structure that engages with the guide protrusion.

DETAILED DESCRIPTION OF THE PREFERRED EMBODIMENTS

A four-way switch according to an aspect of the present invention includes a structure that addresses the problem of two switches operating simultaneously when pushing an edge portion of the knob of the four-way switch, and the problem of not operating accurately in four directions.

Hereinafter, embodiments of the present invention will be described in detail with reference to the accompanying drawings.

Firstly, the terms used in the present specification and claims are to be interpreted not only as regular or dictionary meanings, but also as meanings commensurate with the technical ideas of the present invention.

However, in the present specification, it is to be noted that when a member is provided "above" another member, this includes not only the case where the member is in contact with the other member, but also the case where yet another member is present between the aforementioned two members. Also, in the present specification, when a member is defined as "including" an element, unless stated to the contrary, this does not mean to exclude other elements, but includes a case where other elements are further included.

Figure 1:
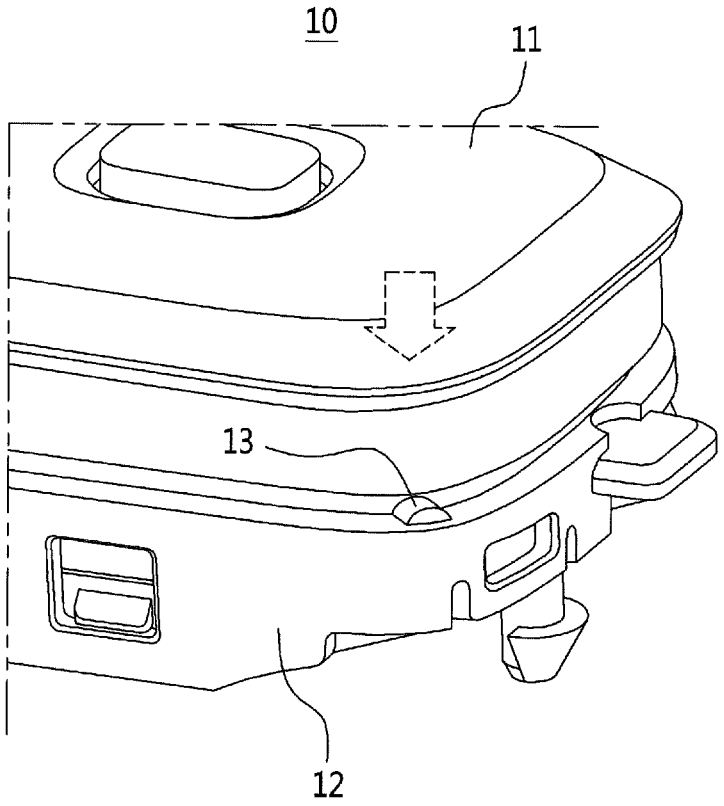
FIG. 1 is a perspective view illustrating a four-way switch according to the conventional technology.
Figure 2:
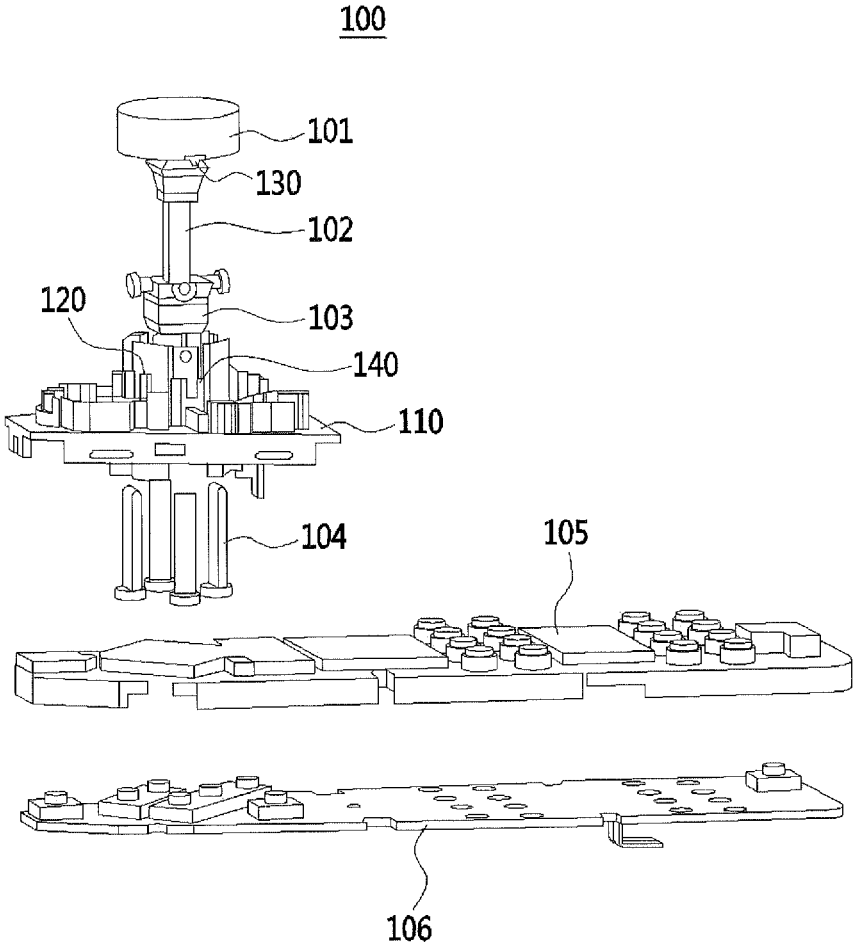
FIG. 2 is an exploded view illustrating a four-way switch according to an embodiment of the present invention.
Figure 3:
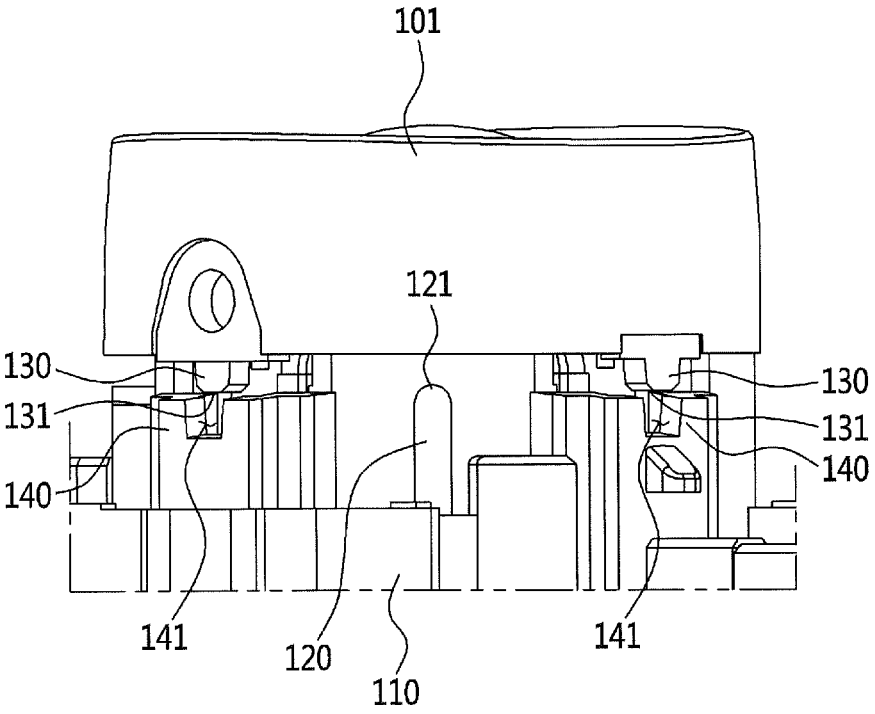
FIG. 3 is an enlarged perspective view of a portion of a four-way switch according to an embodiment of the present invention.
Figure 4:
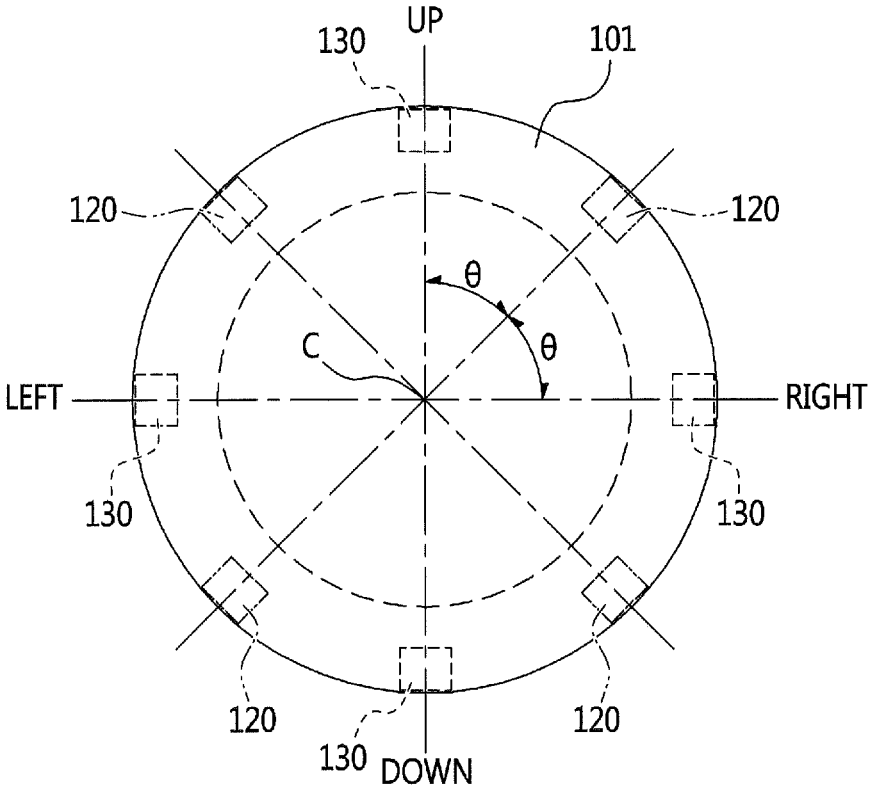
FIG. 4 is a transparent plan view illustrating positions at which the stoppers, the guide protrusions, and the guide groove portions of the four-way switch illustrated in FIG. 3, are formed.

FIG. 2 is an exploded view illustrating a four-way switch according to one embodiment of the present invention. FIG. 3 is a perspective view illustrating an enlarged portion of the four-way switch when a knob is tilted in a direction in which a stopper is formed, according to one embodiment of the present invention. FIG. 4 is a transparent plan view illustrating positions where stoppers, guide protrusions, and guide groove portions of the four-way switch illustrated in FIG. 3, are formed.

Referring to these drawings, a four-way switch 100 according to the present embodiment includes a knob 101 that is tilted in four directions for performing four-way switching operations, and the four-way switch 100 includes a housing 110, stoppers 120, guide protrusions 130, and guide groove portions 140 having specific structures.

The four-way switch 100 according to the present embodiment may further include a mount 106, a rubber 105, an actuator 104, and a holder 103 mounted inside the housing 110 for performing switching operations, as illustrated in FIG. 2. Further, a light guide 102 may be provided so that light can be output to the outside through the knob 101.

The four-way switch 100 according to the present embodiment including the above-described configuration includes the housing 110, the stoppers 120, the guide protrusions 130, and the guide groove portions 140 having specific structures, and is therefore capable of preventing two switches from operating simultaneously when pushing an edge portion of the knob of the four-way switch.

Hereinafter, each configuration of the four-way switch 100 according to the present embodiment will be described in detail with reference to the drawings.

As illustrated in FIG. 3, on one surface of the upper portion of the housing 110, to which the knob 101 is attached in a manner as to be tiltable, the stopper 120 is formed so as to protrude by a predetermined height.

The stopper 120 according to the present embodiment contacts a portion of the lower surface of the knob 101 during a tilting operation of the knob 101, to limit a downward motion of the knob 101.

Specifically, there are a total of four stoppers 120, each of which being disposed in a direction away by a predetermined angle from one of the four directions in which the knob 101 performs the switching operation, in a plan view. Preferably, as illustrated in FIG. 4, each stopper 120 is disposed at a position forming an angle of $\theta=45°$ relative to one of the four directions of the knob 101, centered on the tilt central axis C of the knob 101 in a plan view.

Figure 5:
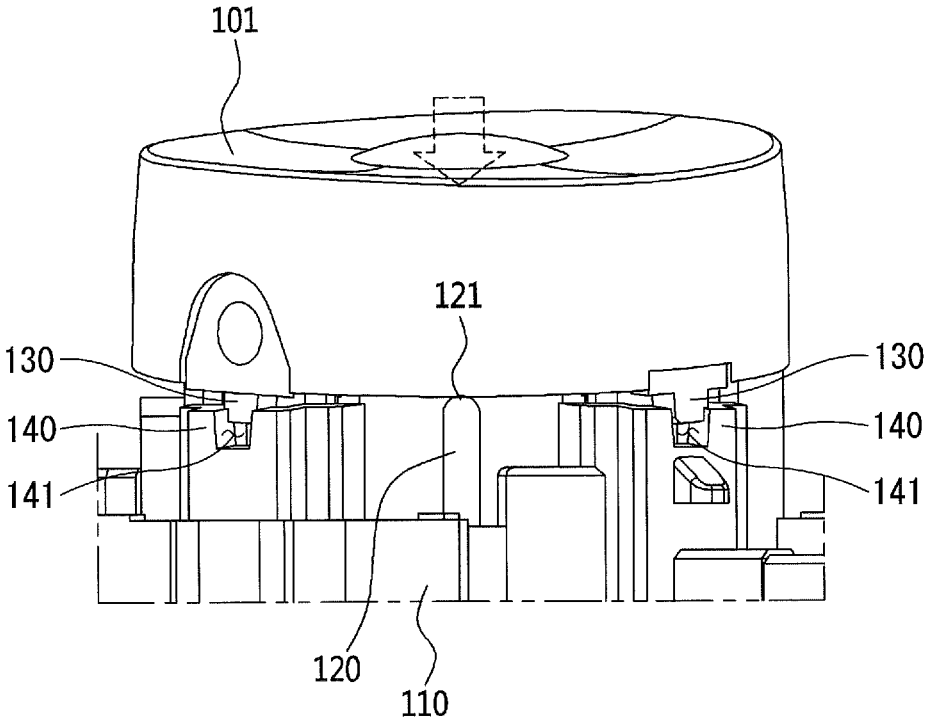
FIG. 5 is a perspective view illustrating an operation in which the knob is tilted in a direction in which the stopper is formed.

More specifically, as illustrated in FIG. 5, the protruding height of the stopper 120 is preferably the height at which the lower surface of the knob 101 contacts the upper surface of the stopper 120 when the knob 101 is tilted and the switching operation is performed.

Figure 6:
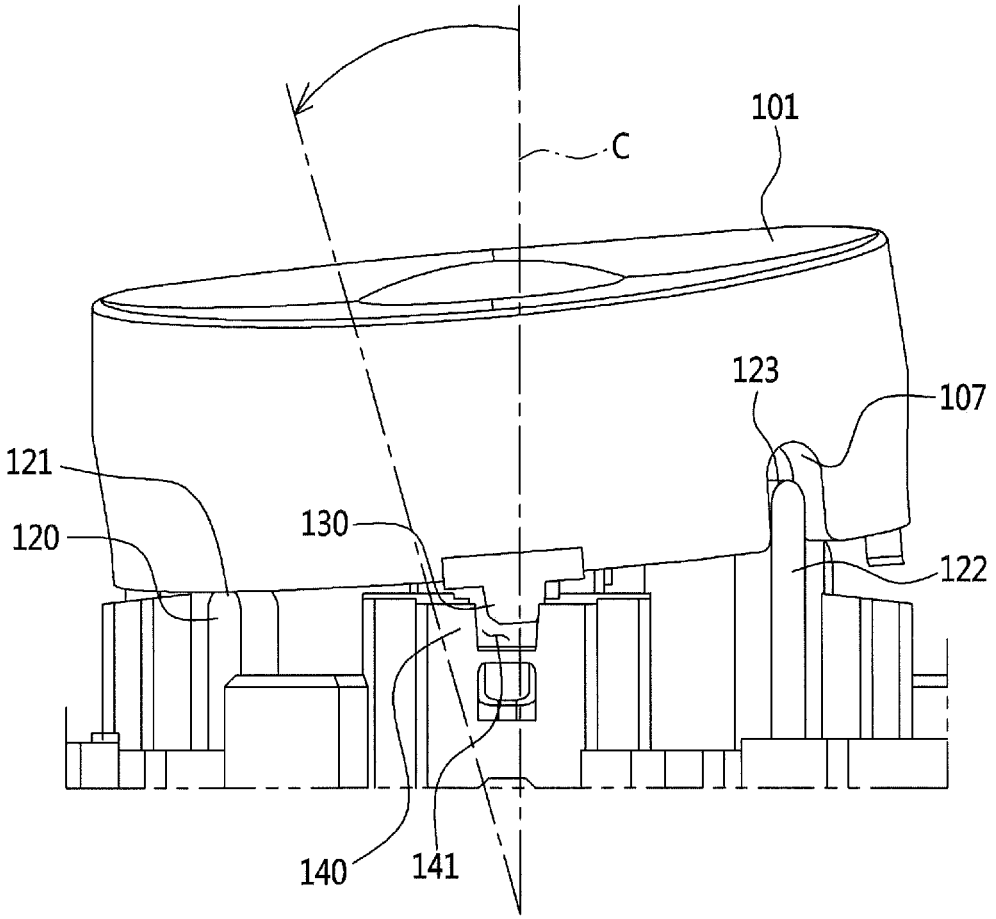
FIG. 6 is a perspective view of the operation illustrated in FIG. 5, viewed from the direction in which the guide projection is formed.

Furthermore, as illustrated in FIG. 6, the height of a stopper 122 may be further increased, and a recess portion 107, having a structure that engages with the stopper 122, may be provided on the lower surface of the knob 101.

In this case, as illustrated in FIG. 6, when the knob 101 is pushed in a tilt direction in which the switching operation is not performed, i.e., when an edge portion of the knob 101 is pushed, the stopper 122 and the recess portion 107 interfere, thereby limiting the tilt motion of the knob 101. As a result, the problem that the two switches operate simultaneously is fundamentally solved, by limiting tilt motion of the knob 101 in the wrong direction with the stopper 122 having a higher height and the recess portion 107 provided on the lower surface of the knob 101.

As illustrated in FIGS. 3 and 6, a round-shaped structure 121, 123 having a predetermined radius may be formed on the top surface of the stopper 120, 122.

In this case, the downward motion of the knob 101 is limited while the lower surface of the knob 101 and the upper surface of the stopper 120, 122 smoothly contact each other.

On the lower surface of the knob 101, the guide protrusions 130 are formed by protruding a predetermined length.

In this case, on one surface of the housing 110, the guide groove portion 140 is formed by protruding by a predetermined height so as to face the guide protrusion 130. More specifically, the inside of the guide groove portion 140 is provided with a recess portion 141 having a structure that engages with the guide protrusion 130.

Specifically, the guide protrusion 130 according to the present embodiment has a predetermined width. Here, as illustrated in FIG. 6, when the knob 101 is tilted in the direction in which the stopper 120 is formed, the guide protrusion 130 and the guide groove portion 140 interfere, thereby limiting downward motion of the knob 101.

More specifically, as illustrated in FIG. 4, it is preferable that there are a total of four guide protrusions 130, each of which being disposed in one of the directions corresponding to the four directions in which the knob 101 performs the switching operation. More preferably, a round-shaped structure 131 having a predetermined radius is formed on the lower surface of the guide protrusion 130.

The recess portion 141 provided in the guide groove portion 140 preferably has a slit structure extending vertically by a predetermined length so that the guide protrusion 130 can engage with/separate from the guide groove portion 140, as illustrated in FIG. 6.

Preferably, there are a total of four guide groove portions 140 according to the present embodiment, each of which being disposed in one of the four directions (up, down, left, right) of the knob 101 illustrated in FIG. 4.

As described above, according to the four-way switch 100 of an embodiment of the present invention, the four-way switch 100 includes the housing 110, the stopper 120, 122, the guide protrusion 130, and the guide groove portion 140 having specific structures, thereby preventing two switches from operating simultaneously when pushing an edge portion of the knob of the four-way switch.

Further, the four-way switch 100 of an embodiment of the present invention is provided with the stopper 120, which is formed by protruding by a predetermined height on one surface of the housing 110, and which contacts a portion of the lower surface of the knob 101 during the tilt motion of the knob 101, thereby limiting the downward motion of the knob 101. Accordingly, when the knob 101 is tilted in the direction of an edge portion that is not one of the four tilt directions for performing the switching operation, the downward motion of the knob 101 is limited, and as a result, it is possible to prevent two switches from operating simultaneously due to the tilt motion of the knob 101.

Further, according to the four-way switch 100 of an embodiment of the present invention, the stopper 120 is disposed at a specific position, and the stopper 120 is formed to protrude by a specific height, so that when the knob 101 is tilted in the direction of an edge portion that is not one of the four tilt directions for performing the switching operation, the downward motion of the knob 101 is effectively limited, and as a result, it is possible to prevent two switches from operating simultaneously due to the tilt motion of the knob 101.

Further, according to the four-way switch 100 of an embodiment of the present invention, the guide protrusion 130 and the guide groove portion 140 are disposed at specific positions, so that when the knob 101 is tilted in the direction of an edge portion that is not one of the four tilt directions for performing the switching operation, the downward motion of the knob 101 is effectively limited, and as a result, it is possible to prevent two switches from operating simultaneously due to the tilt motion of the knob 101.

Further, according to the four-way switch 100 of an embodiment of the present invention, by providing the guide protrusion 130 and the guide groove portion 140 having specific structures, when the knob 101 is pushed in one of the four tilt directions for performing the switching operation, the tilt motion of the knob 101 can be guided in the accurate direction in which the switch operates, and as a result, the operations of the four-way tilt switching can be accurately performed.

According to an aspect of the present invention, a four-way switch includes a knob configured to be tilted in four directions to perform a switching operation in the four directions; a housing to which the knob is attached in a tiltable manner; a stopper formed on a surface of the housing so as to protrude by a predetermined height, the stopper being configured to limit a downward motion of the knob by contacting a portion of a lower surface of the knob while the knob is tilted; a guide protrusion formed on the lower surface of the knob so as to protrude by a predetermined length; and a guide groove portion formed on the surface of the housing so as to protrude by a predetermined height so as to face the guide protrusion, the guide groove portion including a recess portion having a structure that engages with the guide protrusion.

According to an aspect of the present invention, the stopper includes a total of four stoppers, each of the four stoppers being disposed in a direction away by a predetermined angle from one of the four directions in which the knob performs the switching operation, in a plan view.

In this case, for example, each of the stoppers is disposed at a position forming an angle of 45 degrees from one of the four directions of the knob, centered on a tilt central axis of the knob, in a plan view.

Furthermore, the predetermined height to which the stopper protrudes is a height at which the lower surface of the knob and an upper surface of the stopper contact each other, when the knob is tilted to perform the switching operation.

According to an embodiment of the present invention, the lower surface of the knob is provided with a recess portion having a structure that engages with the stopper.

According to an embodiment of the present invention, on an upper surface of the stopper, a round-shaped structure having a predetermined radius is formed.

According to an embodiment of the present invention, the guide protrusion has a predetermined width, and when the knob is tilted in a direction in which the stopper is formed, the guide protrusion and the guide groove portion interfere, thereby limiting the downward motion of the knob.

In this case, for example, the recess portion, which is provided in the guide groove portion, has a slit structure extending vertically by a predetermined length, such that the guide protrusion engages with and separates from the guide groove portion.

According to an embodiment of the present invention, the guide protrusion includes a total of four guide protrusions, each of the four guide protrusions being disposed in a direction corresponding to one of the four directions in which the knob performs the switching operation.

According to an embodiment of the present invention, on a lower surface of the guide protrusion, a round-shaped structure having a predetermined radius is formed.

According to an embodiment of the present invention, the guide groove portion includes a total of four guide groove portions, each of the four guide groove portions being disposed in a direction corresponding to one of the four directions in which the knob performs the switching operation.

As described above, according to the four-way switch of an aspect of the present invention, a housing, a stopper, a guide protrusion, and a guide groove portion having a specific structure are provided, thereby preventing two switches from operating simultaneously when an edge portion of the knob of the four-way switch is pushed.

Further, according to the four-way switch of an embodiment of the present invention, the stopper is formed on a surface of the housing so as to protrude by a predetermined height, the stopper being configured to limit a downward motion of the knob by contacting a portion of a lower surface of the knob when the knob is tilted, so that when the knob is tilted in the direction of an edge portion that is not one of the four tilt directions in which the switching operation is performed, the downward motion of the knob is limited, thereby preventing two switches from operating simultaneously by the tilt motion of the knob.

Further, according to the four-way switch of an embodiment of the present invention, by disposing the stopper at a specific position, and forming the stopper so as to protrude by a specific height, when the knob is tilted in the direction of an edge portion that is not one of the four tilt directions in which the switching operation is performed, the downward motion of the knob is effectively limited, thereby preventing two switches from operating simultaneously by the tilt motion of the knob.

Further, according to the four-way switch of an embodiment of the present invention, by disposing a guide protrusion and a guide groove portion at specific positions, when the knob is tilted in the direction of an edge portion that is not one of the four tilt directions in which the switching operation is performed, the downward motion of the knob is effectively limited, thereby preventing two switches from operating simultaneously by the tilt motion of the knob.

Further, according to the four-way switch of an embodiment of the present invention, by providing a guide protrusion and a guide groove portion having a specific structure, when the knob is pushed in one of the four tilt directions in which the switching operation is performed, the tilt motion of the knob is guided in an accurate direction in which the switch operates, and as a result, the operations of the four-way tilt switching can be accurately realized.

Although the present invention has been described with reference to the embodiments described above, the present invention is not limited to the above-described embodiments, and various modifications can be made within the scope of the claims.

What is claimed is:

1. A four-way switch comprising a knob configured to be tilted in four directions to perform a switching operation in the four directions;

a housing to which the knob is attached in a tiltable manner, a stopper formed on a surface of the housing so as to protrude by a predetermined height, the stopper being configured to limit a downward motion of the knob by contacting a portion of a lower surface of the knob while the knob is tilted, a guide protrusion formed on the lower surface of the knob so as to protrude by a predetermined length; and a guide groove portion formed on the surface of the housing so as to protrude by a predetermined height so as to face the guide protrusion, the guide groove portion including a recess portion having a structure that engages with the guide protrusion, wherein the stopper includes a total of four stoppers including a first stopper and a second stopper having a protruding height from the housing higher than the first stopper, said first stopper being integrated to the housing and configured to directly abut on a lower surface of the knob, the knob has a recess potion having a structure that engages with the second stopper, and the first stopper and the second stopper are disposed at a position forming an angle of 45 degrees from one of the four directions of the knob, centered on a tilt central axis of the knob, in a plan view.

2. The four-way switch according to claim 1, wherein the predetermined height to which the stopper protrudes is a height at which the lower surface of the knob and an upper surface of the stopper contact each other, when the knob is tilted to perform the switching operation.

3. The four-way switch according to claim 1, wherein, on an upper surface of the stopper, a round-shaped structure having a predetermined radius is formed.

4. The four-way switch according to claim 1, wherein the guide protrusion has a predetermined width, and when the knob is tilted in a direction in which the stopper is formed, the guide protrusion and the guide groove portion interfere, thereby limiting the downward motion of the knob.

5. The four-way switch according to claim 4, wherein the recess portion, which is provided in the guide groove portion, has a slit structure extending vertically by a predetermined length, such that the guide protrusion engages with and separates from the guide groove portion.

6. The four-way switch according to claim 1, wherein the guide protrusion includes a total of four guide protrusions, each of the four guide protrusions being disposed in a direction corresponding to one of the four directions in which the knob performs the switching operation.

7. The four-way switch according to claim 1, wherein on a lower surface of the guide protrusion, a round-shaped structure having a predetermined radius is formed.

8. The four-way switch according to claim 1, wherein the guide groove portion includes a total of four guide groove portions, each of the four guide groove portions being disposed in a direction corresponding to one of the four directions in which the knob performs the switching operation.

9. The four-way switch according to claim 1, wherein the first and second stoppers are separately provided with a predetermined distance therebetween.

10. The four-way switch according to claim 1, wherein each of the guide protrusion and the guide groove portion is arranged so as not to overlap the first stopper in a radial direction of the knob, and each of the guide protrusion and the guide groove portion is arranged so as not to overlap the second stopper in the radial direction of the knob.

* * * * *